United States Patent [19]

Krage

[11] 3,936,209

[45] Feb. 3, 1976

[54] METHOD FOR TEXTURING A CONCRETE SURFACE

[75] Inventor: Colonel F. Krage, Sioux City, Iowa

[73] Assignee: Russell B. Dickinson, Des Moines, Iowa

[22] Filed: Mar. 7, 1974

[21] Appl. No.: 449,202

[52] U.S. Cl. ..... 404/75; 264/31; 264/162; 264/163; 264/293; 264/333; 404/89; 404/118

[51] Int. Cl.[2] ..... E01C 7/35

[58] Field of Search ..... 264/162, 163, 284, 293, 264/31, 33, 333; D4/1, 23, 29, 37; 404/75, 89, 118

[56] References Cited

UNITED STATES PATENTS 3,214,777 11/1965 Kutik ..... D4/29 X

OTHER PUBLICATIONS

"Design & Control of Concrete Mixtures", Portland Cement Association, 1948, p. 44.

Fuller Brushes Illustrated, (Catalog), 1951, Fuller Brush Company, Hartford, Conn. pp. 14–15.

*Primary Examiner*—Robert F. White
*Assistant Examiner*—Thomas P. Pavelko
*Attorney, Agent, or Firm*—Zarley, McKee, Thomte & Voorhees

[57] ABSTRACT

The method for texturing concrete comprises pouring uncured concrete into a form or upon a supporting surface troweling the concrete to a relatively smooth surface, and moving a texturing pad across the surface. The texturing pad comprises a backing material and a plurality of tufted clusters arranged in a matrix of rows. The clusters each comprise a base attached to the downwardly presented surface of the backing material and a plurality of blades extending downwardly therefrom to engage the concrete while moving there across. Each of the tufts is formed from a plastic material and is of unitary construction.

1 Claim, 4 Drawing Figures

METHOD FOR TEXTURING A CONCRETE SURFACE

SUMMARY OF THE INVENTION

This invention relates to a method for texturing concrete surfaces. In paving of highways and roads, it is necessary to texture the surface of the paving so as to provide a non-skid surface for vehicles. The texturing should be sufficiently rough to provide a good non-skid surface, but should not interfere with the operation of the vehicle. Furthermore, it is desirable that the textured surface not wear away in a short time but have substantial durability.

Various methods have previously been used to texture the surface of highways. One prior method for texturing concrete is to drag a wire brush with wire tines across the surface of the concrete. This method however has the disadvantage of tearing out the aggregate in the concrete and it also makes long grooves which are undesirable. These grooves made by wire tines can have an effect similar to that encountered with streetcar tracks in a street. The grooves tend to make steering of the vehicle difficult.

Burlap has also been used to texture concrete. The problem with burlap is that it becomes matted with the concrete and must be cleaned often or replaced.

A combination of burlap with nails extending therethrough has also been used. However, the nails create grooves similar to those created with the wire brush tines, and therefore this method has been found undesirable. Indoor and outdoor carpeting have also been used, but these materials become matted quickly and are therefore undesirable.

The present invention utilizes a plastic artificial grass material manufactured by Monsanto, 800 North Lindberg Boulevard, St. Louis, Mo. 63166. The product is manufactured under the trademark "AstroTurf." The grass material is moved or dragged across the surface of the concrete with the grass material being downwardly presented. The material is self-cleaning and does not become matted as with other types of carpet. The material drags in a straight line and does not "fish tail" as it is being dragged across the concrete. It does not make undesirable grooves, but the individual blades of the grass wiggle to make an irregular textured pattern which provides a good high-friction surface for vehicles. There is no need to place weights on the material as it is being dragged across the concrete, and the blades of grass do not tear out the aggregate in the concrete as with the wire tines presently being used. The textured surface which is created by this method also appears to be more durable than previous textured surfaces.

Therefore, a primary object of the present invention is the provision of a method which will create a texture for concrete surfaces.

A further object is the provision of a method which utilizes a texturing device which does not mat and cleans easily.

A further object of the present invention is the provision of a method which utilizes a texturing device which frags in a straight line and does not fish tail.

A further object of the present invention is the provision of a method which does not result in undesirable grooves which might give a "street car rail" effect to vehicles driving on the surface.

A further object of the present invention is the provison of a method which utilizes blades which wiggle to make an irregular pattern during the texturing process.

A further object of the present invention is the provision of a method for texturing surface which requires no weights being placed on the texturing device.

A further object of the present invention is the provision of a method which does not tear out the aggregate during the texturing process.

A further object of the present invention is the provision of a method which textures concrete and results in a more durable texturing which will not wear away in a short time.

A further object of the present invention is the provision of a method wherein uniform texture is obtained across the entire contour of the paving surface including low spots, curves, or slopes in the surface.

This invention consists in the construction, arrangements and combination of the various parts of the device, whereby the objects contemplated are attained as hereinafter more fully set forth, specifically pointed out in the claims, and illustrated in the accompanying drawings in which:

DETAILED DESCRIPTION OF THE INVENTION

Figure 1:
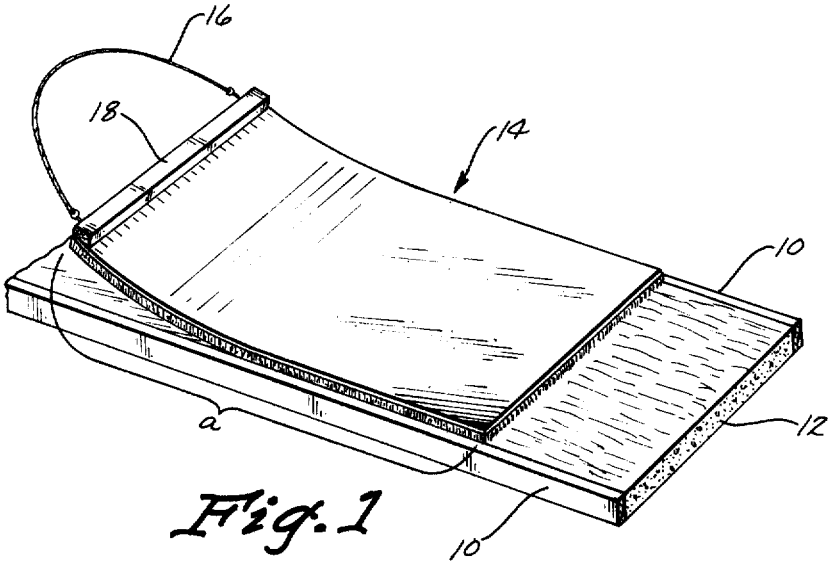
FIG. 1 is a pictorial view illustrating the use of the pad for texturing a concrete surface.

Referring to FIG. 1, the method of the present invention is illustrated in its simplest form. A pair of concrete forms 10 enclose some freshly poured concrete 12. Prior to the texturing process the concrete is troweled to a relatively smooth surface in conventional manner. This step in the process has not been shown in the drawings inasmuch as such troweling is conventional and well known in the art.

After the concrete has been troweled, a texturing pad 14 is moved or dragged across the surface of the concrete so as to impart the texture thereto. FIG. 1 illustrates the texturing pad in its simplest form having a looped handle 16 which may be pulled manually to create the texturing surface. However, pad 14 will work equally well when secured to the rearward end of a paving machine. Furthermore, while pad 14 is illustrated as being drawn longitudinally with respect to forms 10, the pad will function equally as well for non-highway usage if pulled laterally across the concrete with respect to the longitudinal direction of the forms. Handle 16 is secured to a two by four board which in turn is secured to one end of pad 14. The length *a* of pad 14 dragging behind board 18 may vary without detracting from the invention. However, a length of three feet or less has been found satisfactory. Furthermore, the width may be varied to accommodate the width of the highway being paved.

Figure 2:
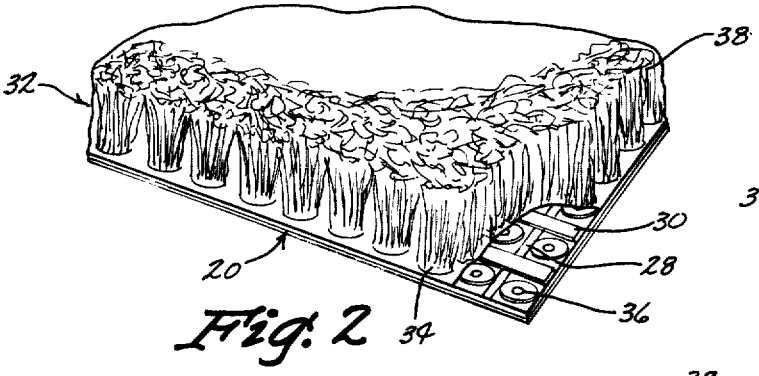
FIG. 2 is a detailed pictorial view of the structure of the pad used for the present method.
Figure 3:
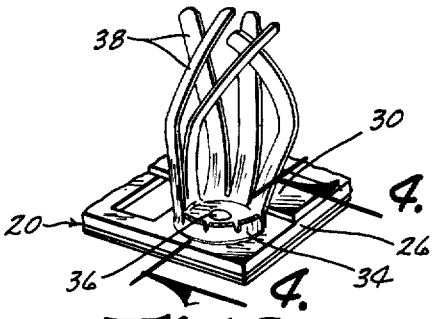
FIG. 3 is a detailed pictorial view of one tuft or cluster on the mat used for the present method.
Figure 4:
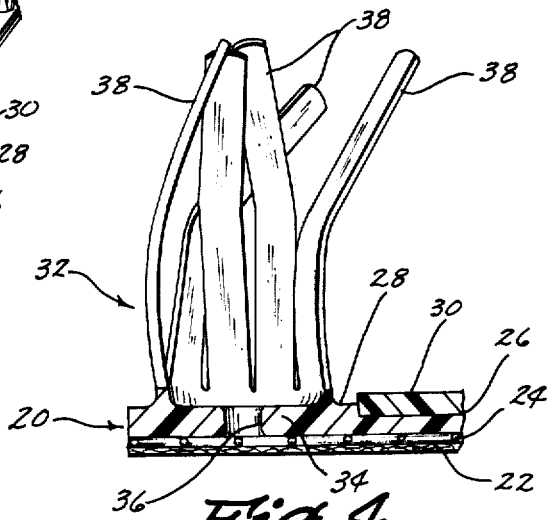
FIG. 4 is a section of view taken along line 4—4 of FIG. 3.

The mat for texturing the concrete for use with the present invention is an artificial turf material manufactured by Monsanto, a company in St. Louis, Missouri. The product is marketed under the trademark AstroTurf and is designated by the product code "CH-4." FIGS. 2–4 illustrate the structure of this material.

A backing material 20 is comprised of a secondary substrate 22, a primary substrate 24, and a molded facing material 26. Secondary substrate 22 is a spun nylon fabric laminated to the back of the base. Primary substrate 24 is a mesh woven nylon scrim fabric imbedded into the back of the molded facing material. Molded facing material 26 is a molded polyethylene material. It comprises a lattic network of polyethylene strips 28, 30 which criss cross in a lattice-like fashion. A plurality of tufted clusters 32 are molded into facing material 26 in the spaces between strips 28, 30. Strips 28, 30 and tufted clusters 32 are fused together so as to be of unitary construction.

Each cluster 32 comprises a base 34 having an aperture 36 extending therethrough so as to permit moisture to pass through backing material 20. Extending upwardly in a circular array around base 34 are a plurality of blades 38. Blades 38 are approximately seven-eighths of an inch long, have a width of approximately one-sixteenth of an inch and have a thickness of approximately one thirty-second or one sixty-fourth of an inch. While these dimensions may be varied without detracting from the invention, it has been found that these dimensions of the blades work satisfactorily.

Each blade is bent intermediate its length so that it deviates from a straight line as it extends upwardly from base 34. This bent configuration of each blade 38 creates a non-uniform array of blades extending upwardly from tufted clusters 32. Consequently, the pile created by blades 38 does not have a uniform grain to it. This grain may be illustrated by placing a drinking glass on top of the surface and depressing it slightly. The various blades pressing against the bottom of the glass will fold in a plurality of directions with the pad of the present invention. If this test is applied to many carpet materials, it will be observed that most carpets will fold uniformly in one direction.

This irregular grain in the blades of pad 14 is believed to contribute to the proper texturing of the concrete inasmuch as the blades wiggle in a plurality of directions as they are being dragged across the surface of the concrete. While each tufted cluster 32 includes eight blades, the number of blades to each cluster and the respective distances between the clusters may be varied without detracting from the invention.

When the pad of the present invention is utilized, it requires little or no cleaning. It does not fish tail and it does not make undesirable grooves in the concrete. The individual blades wiggle to irregular patterns and there is no need for placing weight on the pad as it is being dragged across the concrete. The blades do not tear out the aggregate, but merely create a texture in the top of the surface which is believed to be very durable.

One problem encountered with prior art devices is the difficulty in obtaining a uniform texture throughout the contour of the paving surface. Often the paving surface includes low spots, small rises or humps, slopes, or curves which are difficult to texture uniformly. Many prior art devices gouge deeper grooves in the humps of the contour and often leave the low spots completely untextured. Furthermore, on curves of the highway, there is often a slope to the surface which results in uneven texturing. Prior art texturing devices often gouge one side of a sloped surface and leave the other side partially untextured. The pad of the present invention, however, seems to seek out low spots and rise uniformly across the surface of the paving regardless of the contour thereof. Consequently, the resulting texture is uniform regardless of whether or not there are slopes, low spots, or raised humps. Thus it can be seen that the device accomplishes all of its stated objectives.

I claim:

1. A method for texturing concrete for use as a supporting surface for vehicle travel, comprising:

pouring uncured concrete on a supporting surface area, troweling said concrete to the approximate desired surface configuration, dragging a texturing pad over the surface of said concrete in the normal direction of travel of vehicles on the resulting supporting surface, said texturing pad comprising a planar flexible sheet of backing material and a plurality of downwardly presented tufted clusters arranged in a matrix of rows and extending downwardly from said backing material; said clusters each comprising a base attached to the downwardly presented surface of said backing material and a plurality of blades extending downwardly therefrom in a circular array around said base to engage said concrete while moving thereover, each of said clusters being formed from a plastic material, each of said blades being bent intermediate its ends and being flexible so as to deflect irregularly in a plurality of directions whereby said plurality of blades create nonuniform marks in said concrete while being dragged thereover.

* * * * *